US007083358B2

(12) United States Patent
Grosjean

(10) Patent No.: US 7,083,358 B2
(45) Date of Patent: Aug. 1, 2006

(54) AQUATIC WEED SUPPRESSOR

(76) Inventor: Warren J. Grosjean, 32 Juniper Rd., Wayne, NJ (US) 07470-6156

( * ) Notice: Subject to any disclaimer, the term of this patent is extended or adjusted under 35 U.S.C. 154(b) by 0 days.

(21) Appl. No.: 10/825,166

(22) Filed: Apr. 16, 2004

(65) Prior Publication Data

US 2005/0232699 A1 Oct. 20, 2005

(51) Int. Cl.
*E02B 3/12* (2006.01)

(52) U.S. Cl. ..... 405/16; 405/129.9; 405/258.1; 405/270; 405/302.7; 47/9; 47/31

(58) Field of Classification Search ..... 405/16, 405/17, 258.1, 302.7, 129.45, 129.75, 129, 405/270; 47/9, 31; 428/134, 136, 919
See application file for complete search history.

(56) References Cited

U.S. PATENT DOCUMENTS 3,649,724 A * 3/1972 Rembert et al. ..... 264/459
3,696,623 A * 10/1972 Heine et al. ..... 405/19
3,854,292 A * 12/1974 Nienstadt ..... 405/270
3,962,083 A * 6/1976 Goldman ..... 134/9
4,044,501 A * 8/1977 Frydryk ..... 47/31
4,056,936 A 11/1977 Mayer
4,239,824 A * 12/1980 Kasten ..... 428/13
4,344,722 A * 8/1982 Blais ..... 405/129.75
4,405,264 A * 9/1983 Brady et al. ..... 405/270
4,518,280 A 5/1985 Fletcher
4,565,468 A * 1/1986 Crawford ..... 405/129.75
4,577,996 A 3/1986 Elias
4,854,773 A * 8/1989 Nicoll ..... 405/19
4,982,526 A * 1/1991 Miyachi ..... 47/9
5,417,010 A * 5/1995 Ecer ..... 47/56
6,141,993 A * 11/2000 Whitbeck ..... 66/195
6,357,964 B1 * 3/2002 DeGarie ..... 405/129.57
6,428,240 B1 * 8/2002 Ehrlich et al. ..... 405/114
6,558,079 B1 * 5/2003 Kozak et al. ..... 405/129.15
6,755,596 B1 * 6/2004 Schibi ..... 405/270

FOREIGN PATENT DOCUMENTS

WO 0030428 * 6/2000

* cited by examiner

*Primary Examiner*—Jong-Suk (James) Lee
(74) *Attorney, Agent, or Firm*—Cowan, Liebowitz, & Latman, P.C.

(57) ABSTRACT

A sub surface aquatic weed barrier consisting of a strip of plastic held to the aquatic substrate by transverse weights bonded to the plastic strip. Gas release ports are located in the plastic sheet, positioned midway between the transverse weights.

5 Claims, 1 Drawing Sheet

AQUATIC WEED SUPPRESSOR

STATEMENT REGARDING FEDERALLY SPONSORED RESEARCH

There was no Federal support for this research or development.

CROSS REFERENCE TO RELATED APPLICATIONS

Not applicable.

BACKGROUND OF THE INVENTION

This invention is in the field of the suppression of sub-surface aquatic weed growth. More specifically, this invention relates to a sub-surface aquatic weed barrier consisting of a strip of plastic, with a series of gas release ports, which is held down by transverse weights bonded to the plastic strip.

Some relative patents:

| | | | |
|---|---|---|---|
| 4056936 | November 1977 | Mayer | 405/302.7 |
| 4518280 | May 1985 | Fletcher | 405/17 |
| 4577996 | March 1986 | Elias, Fletcher | 405/17 |

The problem with weed infestation in relatively shallow (eight feet or less) bodies of water whether they be ponds, lakes, canals, irrigation ditches, or tidal areas has been increasingly obvious. (See: Michigan State University manual E-2437 issued 12/98 titled "Aquatic Pest Management" with particular reference to Chapter 6. Another relative article can be found at "www.Army.mil/el/aqua/apis/mechanical/eurasian.html). The condition is evident in almost any aquatic environment where there is relatively slow movement of the water. Aquatic weed growth has a deleterious effect on aquatic activities and can be a health hazard. If permitted unchecked the ultimate result of aquatic weed growth is the transformation of the body of water into swamp and eventually into great farm land. The relatively recent introduction of Eurasian Milfoil into the US Northeast's aquatic ecosystem has been a disaster. Some idea of the costs relating to the control of aquatic weeds can be gleaned from a report of the projects funded by the State of Washington under their Aquatic Weeds Program for the period 1994 to 2000 found at site: "www.ecy.gov/programs/wq/plants/grants/projects.html"

A review of the literature indicates that many solutions have been proffered:

1) Mostly they involve the repeated use of chemical agents. The EPA's interest in these chemical treatments has tended to limit their use and effectiveness and the repeated applications are costly.

2) Another proffered solution is the mechanical removal by cutting or pulling out the objectionable weeds. The required continuous application of such procedures, their labor intensive nature, and the problems with the disposal of the removed material have limited the use of these techniques.

3) Yet another solution is the lowering of the body of water in the Fall of the year and trusting in mother nature to kill the weeds and their seeds. This requires a significant lowering of the water level through a period of deep freezing and has proven to be only a slight mitigator of the problem in the next season. Also most affected bodies of water can not be lowered adequately or there is not the potential for deep freezing. And, the most serious objection to this solution, the surviving weeds are generally the naiads and the Eurasian Milfoil—the major problems.

4) Another proffered solution is the covering of the soil below the water with a shield of some sort to stop the sun's rays from stimulating weed growth. The trick here is to keep the cover, usually a plastic film or screen, down on the ground below the water while permitting the gases resulting from decomposition to escape.

5) Another solution is the introduction of grass eating fish. The down sides here include the fact that these particular fish prefer other weeds than Eurasian Milfoil and therefore remove the desirable weeds before attacking the problem weeds and the need to feed the fish after the weeds are eaten.

6) The solution theoretically most acceptable is the deepening of the water to the point where inadequate sunlight gets to the aquatic substrate to foster the growth of weeds or when weeds grow they do not reach the surface of the water. In most instances this is not a practical solution.

It therefore would be desirable to provide an aquatic weed suppressor which is economical, easy to install and not overly labor-intensive, long-lasting, will remain in place, and will effectively kill all types of targeted weeds.

SUMMARY OF INVENTION

A means of blocking the sun's rays so that they do not stimulate aquatic plant growth by covering the substrate with an opaque film, said film being held to the substrate by heavier than water "bars" either integral with the film, attached to the film, or otherwise positioned on the film in a configuration that causes the gases of decomposition to migrate to sections of the film where there have been located gas release ports.

It is therefore an object of the present invention to prevent the growth of submersed aquatic weeds by restricting sunlight reaching the aquatic substrate.

It is another object of the present invention to provide an aquatic weed suppressor wherein the sunlight barrier is kept in place on the aquatic bed; without a need to add rocks or other weights.

It is another object of the present invention to provide an aquatic weed suppressor whereby the gases of decomposition at the substrate readily escape the sunlight barrier by being directed to exhaust ports.

It is yet another object of the present invention to provide an aquatic weed suppressor that can be placed at any time, even when the weeds are in full growth and in any depth of water without anyone necessarily going into the water.

It is another object of the present invention to provide an aquatic weed suppressor whose life expectancy in lake water conditions is limited only by the degradation of the barrier by sunlight or the accumulation of sediment on the barrier.

It is still another object of the present invention to provide an aquatic weed suppressor that is cost effective, easy to install, and environmentally friendly.

In accordance with the present invention, a means of blocking the sun's rays so they do not stimulate aquatic plant growth is provided. The invention includes an opaque film which is held down on the substrate by bars which are heavier than water The bars are integral with the film, attached to the film, or otherwise positioned on the film in a configuration that causes gases of decomposition to migrate to sections of the film where the gases can escape from under the film through release ports.

DESCRIPTION OF THE PREFERRED EMBODIMENTS

Figure 1:
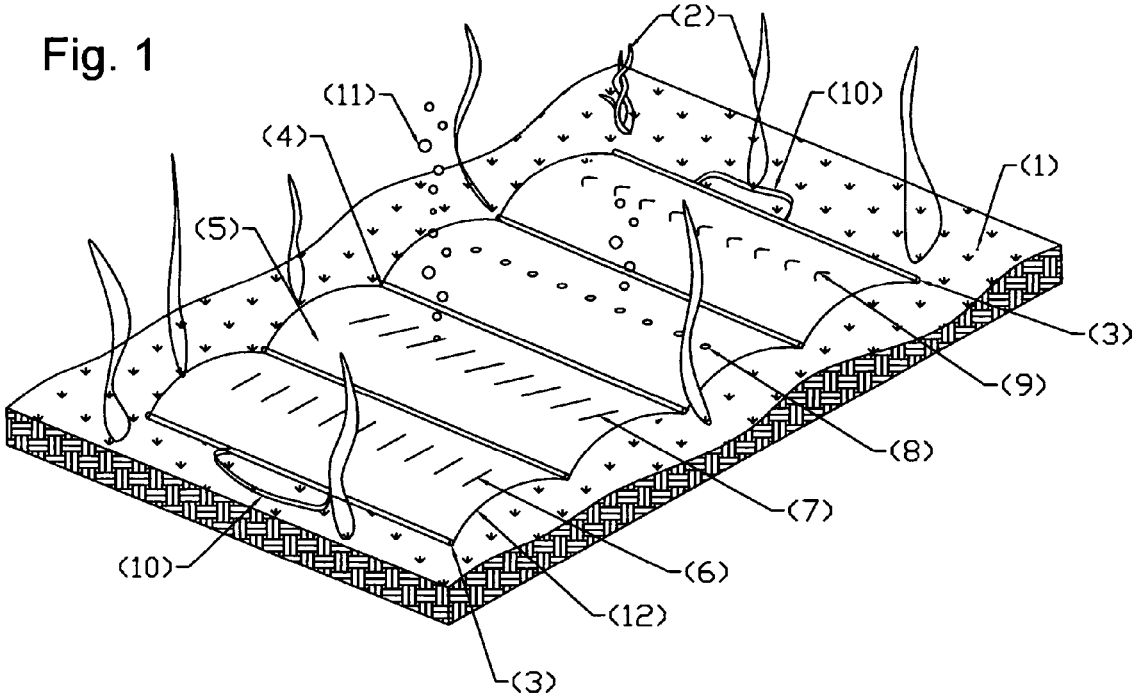
FIG. 1 is a view of the aquatic weed suppressor in position on the bottom of a water.

Bearing in mind that the objective is to stop the growth of objectionable weeds (2) in aquatic environments inexpensively and with no environmental damage I propose this wimple device consisting of a strip of plastic sheeting (5) of whatever width and length is appropriate for manufacture and use with multiple laterally oriented weights (4) appropriate for holding the sheet to the substrate (1) and with decomposition gas (11) emission ports (6,7,8 or 9) in the sheet midway between the hold down means.

The ideas sheet material is one with a specific gravity of less than one. Material cost and buoyancy considerations encourage the use of the thinnest film material consistent with strength and optical density. Low density polyethylene of thickness about 0.001", similar to the material gardeners use to prevent weed growth in their gardens, is functionally and economically an appropriate sheeting material. Under conditions of possible turbulence, such as ocean fronts, or where there are sharp rocks on the bottom it could be good practice to use a reinforced or otherwise tougher material.

The width of the sheets would normally be from five to twenty feet. To cover larger areas, multiple sheets would be laid side by side. The length of the sheets is limited only by the ability to handle and install.

The hold down means can be almost anything ranging from aggregate or rebar encased in tubes attached to or a part of the plastic film, to a film adherent material itself heavy or with sand or metal inclusions (4). It is only important that the weight of the hold down means (4) be adequate to hold the sheet (5) in place and to direct the decomposition gases (11) to the exit ports (6–9).

The hold down means (4) would be longitudinally spaced from one to five feet apart with two to three feet appropriate under most conditions. The hold down means at the ends of the strips (3) should be particularly stiff to facilitate installation and removal; ⅜ inch rebar encased in plastic tubes attached to the plastic sheet is appropriate; also plastic rope (10) attached to the stiff end bars can serve as handles to facilitate installation and removal.

The plastic film (5) will take a convex configuration (12) between the hold down means (similar to a Quonset hut) both as a result of its less than one specific gravity and the uplifting effects of the gases of decomposition (11). At the top of this "hut" there are ports of design (6,7,8, or 9) cut in the plastic film laterally spaced from one to three feet. Since these ports are at the top of the "hut" they are above the substrate by several inches and although some sun light may get through the ports it is transient and is therefore inadequate to encourage plant growth.

The shape of these ports may be anything from (6) a simple longitudinal slit of length 2 or more inches, (7) a slit oriented at an angle up to ninety degrees from longitudinal (As the slit orientation approaches lateral, its length should be decreased so as to limit the sunlight incidence on to the substrate.), (8) a small hole (⅛th inch would be about right.), or (9) a configuration similar to a "C" where the sheet material acts as a valve flap. The longitudinal slit (6) is favored as being the least costly to manufacture and it does the job.

One limitation on the useful life of this type of barrier is the effect of sediment accumulation. Using a plastic material with a specific gravity of less that one results in the plastic sheet rising between the hold down means into a convex configuration (12). As sediment drops to the bottom of the lake, it tends to slide down the surface of the plastic and accumulate t the hold down means, having then no detrimental effect on the gas emitting functions of the plastic sheet. Unless there is very significant sediment accumulation, weed growth will be discouraged and fragile because of the inability of the weeds to establish strong root systems.

Figure 2:
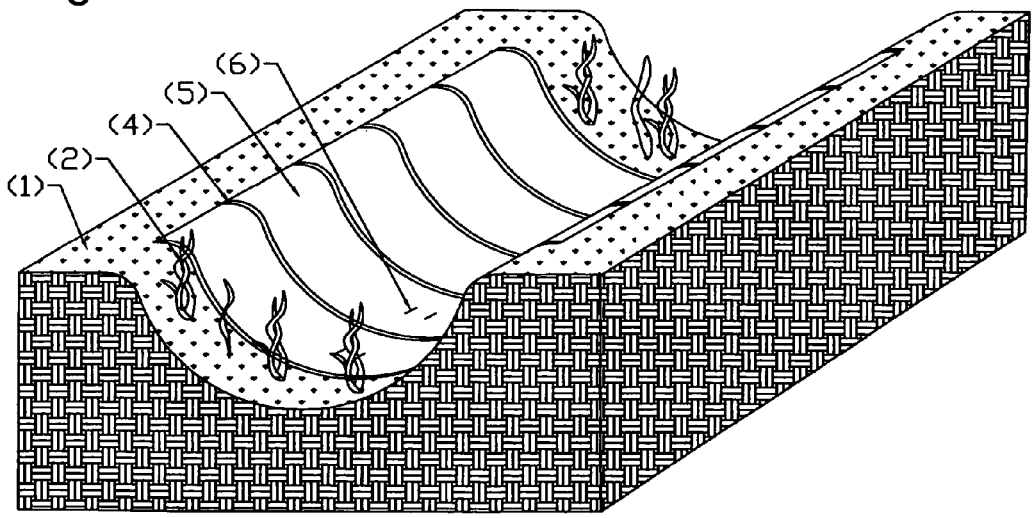
FIG. 2 is a view of the aquatic weed suppressor ad it would be positioned in an irrigation ditch.

One can even conceive that in the case of irrigation or drainage ditches (FIG. 2), the plastic film (5) is of width adequate to span the ditch and of whatever length the installer feels is appropriate. At intervals of about three feet along the length of the strip (5) transverse tubes (4) are attached to the strip or integral with the strip. These tubes re filled with the appropriate aggregate at the time of installation. This hold down means could be sand, cement, or gravel. The cement has the advantage, after hardening, of providing a rigid structure fitting exactly the contours of the ditch. Under some circumstances it would be appropriate for the sheet (5) to be reinforced plastic.

When plastic tubes are utilized to secure the hold down means (4), the attachment of the plastic sheets (5) to the hold down means tubing can be accomplished by a variety of means including gluing, welding, clipping or stitching. When rebar is to be used as the hold down means, it can be coated or incased to minimize the potential for rusting.

One method of installation of this weed suppressor in a lake would be as follows: The suppressor is supplied to the site accordion pleated and loaded on to the stern of a row boat. The free end is pulled off and held with the attached rope handle (10). The boat is then rowed out and the pleated material allowed to peal off. When fully dispensed, the suppressor is pulled reasonably taunt and the end released to settle to the bottom. Additional strips can be positioned next to one another with some overlapping.

I claim:

1. An aquatic weed suppression means comprising:

a strip of plastic of width five or more feet and having a specific gravity of one or less;

a plurality of transverse hold down means, either integral with or fixed to the strip of plastic, running substantially the entire width of the strip of plastic and spaced between one and five feet apart; and a plurality of gas release ports in the plastic strip located between the transverse hold down means, and spaced between one and four feet apart in the direction of the width of the plastic strip.

2. An aquatic weed suppression means in accordance with claim 1 wherein the gas release ports are slits or small holes.

3. An aquatic weed suppression means in accordance with claim 2 wherein the slits are about three inches long and positioned so as to be not substantially parallel to the width of the plastic strip.

4. A weed suppression means for use in irrigation and drainage ditches, comprising:

a strip of plastic of width adequate to span the ditch and of length appropriate for ease of installation; and a plurality of transverse, hollow plastic tubes, either integral with or fixed to the strip of plastic and positioned across the width of the strip of plastic, spaced about every three feet and fillable with sand, cement, aggregate or other material adequate to hold the plastic strip in close proximity to the contour of the ditch.

5. A weed suppression means in accordance with claim 4 wherein the specific gravity of the plastic strip is greater than 1.

* * * * *